US008052484B1

(12) United States Patent
Salisbury et al.

(10) Patent No.: US 8,052,484 B1
(45) Date of Patent: Nov. 8, 2011

(54) ELECTRICAL CONNECTOR WITH OFFSET MATING SURFACES

(75) Inventors: George Alan Salisbury, East Hampton, CT (US); Royce E. Tatton, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 12/905,682

(22) Filed: Oct. 15, 2010

(51) Int. Cl.
*H01R 13/64* (2006.01)

(52) U.S. Cl. ..... 439/680

(58) Field of Classification Search ..... 439/680, 439/681, 617, 924.1, 489, 912, 352, 181
See application file for complete search history.

(56) References Cited

U.S. PATENT DOCUMENTS 3,678,441 A * 7/1972 Upstone et al. ..... 439/272
6,259,170 B1 7/2001 Limoge et al.
6,364,692 B1 * 4/2002 Okayasu et al. ..... 439/426
6,428,339 B1 8/2002 Davidson et al.
6,746,284 B1 * 6/2004 Spink, Jr. ..... 439/740
6,855,007 B2 * 2/2005 Irish et al. ..... 439/614
6,857,903 B2 * 2/2005 Hyde ..... 439/598
7,182,640 B2 2/2007 Garrett et al.
7,347,703 B2 3/2008 Gallardo
7,390,222 B2 * 6/2008 Ciancanelli et al. ..... 439/617
7,631,838 B2 12/2009 Layland et al.
2006/0247753 A1 * 11/2006 Wenger et al. ..... 607/126
2008/0182454 A1 * 7/2008 Zayas ..... 439/617
2009/0124105 A1 * 5/2009 Lindsay ..... 439/246

* cited by examiner

*Primary Examiner* — Tulsidas C Patel
*Assistant Examiner* — Harshad Patel
(74) *Attorney, Agent, or Firm* — Kinney & Lange, P.A.

(57) ABSTRACT

An electrical connector includes an electrically insulating body having a base mating surface and a stepped mating surface offset from the base mating surface. The electrical connector either has first and second electrically conducting pins extending from the base and stepped mating surfaces, respectively, or has first and second electrically conducting sockets extending from an interior portion of the electrically insulating body to the base and stepped mating surfaces, respectively.

16 Claims, 5 Drawing Sheets

ELECTRICAL CONNECTOR WITH OFFSET MATING SURFACES

STATEMENT OF GOVERNMENT INTEREST

The U.S. Government has a paid-up license in this invention and the right in limited circumstances to require the patent owner to license others on reasonable terms as provided for by the terms of Contract No. N00019-02-3003 awarded by the United States Navy.

BACKGROUND

The present invention relates to electrical connectors, and in particular, to compact electrical connectors. Certain complex systems, such as a gas turbine engine, include both mechanical subsystems and electrical subsystems. Certain mechanical subsystems can be subjected to relatively large forces, and therefore require relatively strong components. The electrical subsystems typically require an electrical connection for power transmission, signal transmission, or both. In gas turbine engines and other systems where space is a premium, it can be difficult to locate cables and electrical connectors in positions suitable to make electrical connections for the electrical subsystems while limiting negative impact on structural strength of components of the mechanical subsystems.

For example, it may be desirable to drill a hole through a mechanical component in order to run a cable to an electrical subsystem. However, drilling a hole large enough for a standard electrical connector can undesirably reduce strength of the mechanical component below a suitable threshold. The difficulty with using a smaller connector is that if the connector's pins or other contact element get too close together, arcing can occur between the pins, causing equipment to function improperly and/or become damaged.

SUMMARY

According to the present invention, a male electrical connector includes an electrically insulating body having a base mating surface and a first stepped mating surface offset from the base mating surface. A first electrically conducting pin extends from the base mating surface. A second electrically conducting pin extends from the first stepped mating surface.

Another embodiment of the present invention is a female electrical connector that includes an electrically insulating body having a base mating surface and a first stepped mating surface offset from the base mating surface. A first electrically conducting socket extends from an interior portion of the electrically insulating body to the base mating surface. A second electrically conducting socket extends from the interior portion of the electrically insulating body to the first stepped mating surface.

DETAILED DESCRIPTION

Figure 1:
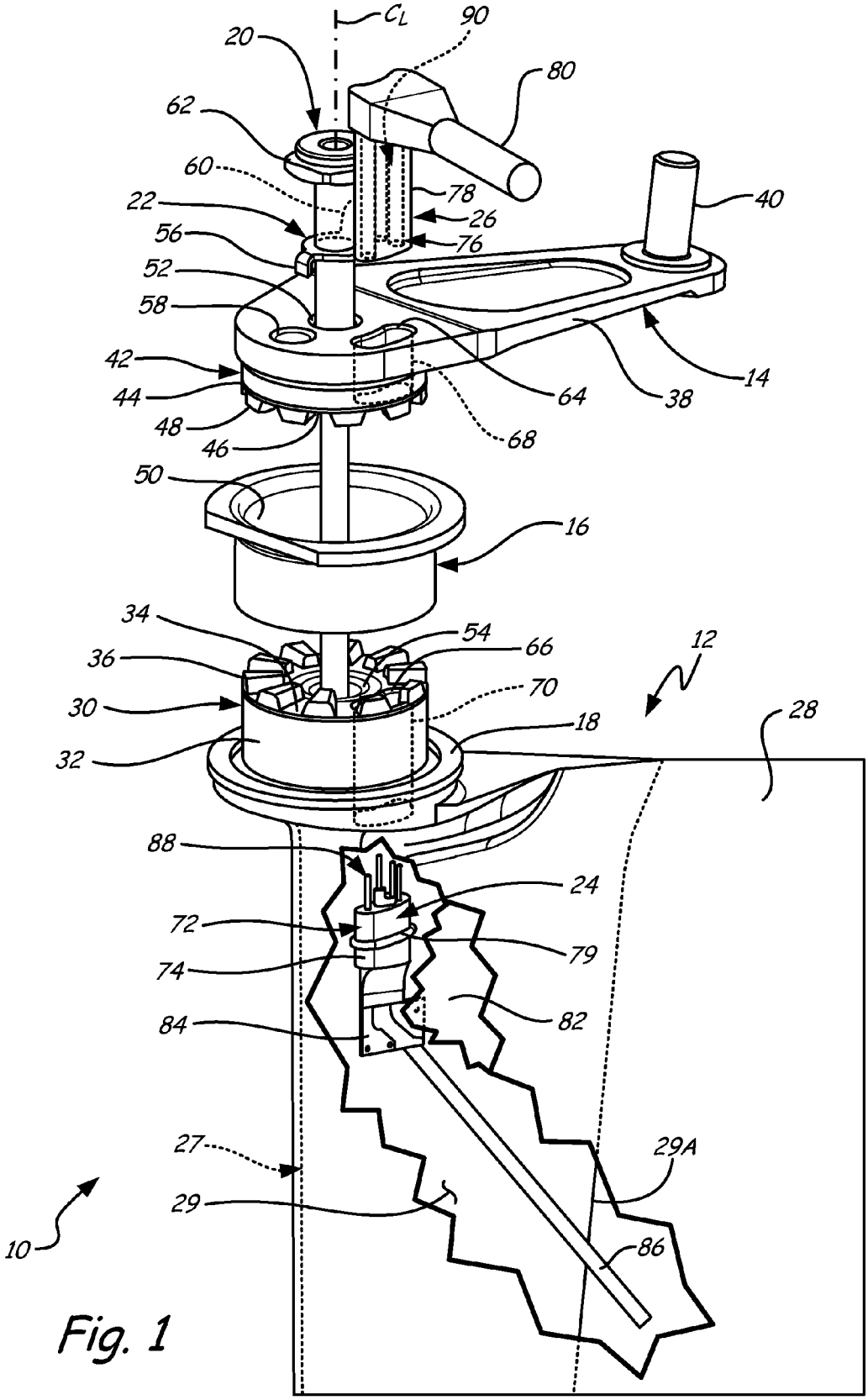
FIG. 1 is a schematic perspective partially cut-away exploded view of a connection assembly.

FIG. 1 is a schematic perspective exploded view of connection assembly 10. Connection assembly 10 includes fan inlet variable vane (FIVV) 12, vane arm 14, bushing 16, washer 18, hinge pin 20, tab washer 22, male connector 24, and female connector 26. FIVV 12 is a rotatable vane positioned at an inlet of a gas turbine engine (not shown). As FIVV 12 rotates, FIVV 12 can increase or decrease the amount of air entering at the inlet of the gas turbine engine. FIVV 12 includes metal spar 27 covered by composite layers 28. Metal spar 27 provides structural support for FIVV 12, and includes spar blade 29 and shaft 30. Composite layers 28 can include multiple layers which cover spar blade 29 and extend past trailing edge 29A of spar blade 29. In FIG. 1, composite layers 28 have been partially cut-away to show details within. Shaft 30 has a substantially cylindrical perimeter 32 and a substantially circular shaft end 34 with teeth 36 extending therefrom.

Vane arm 14 has arm portion 38 connecting handle pin 40 to shaft 42. Like shaft 30, shaft 42 also has a substantially cylindrical perimeter 44 and a substantially circular shaft end 46 with teeth 48 extending therefrom. Teeth 36 mesh with teeth 48 to allow couple shafts 30 and 42 together to rotate inside bushing 16 about centerline axis $C_L$. Bushing 16 has a substantially cylindrical inner surface 50 and functions to limit wear as shafts 30 and 42 rotate against bushing 16. Bushing 16 can be connected to or integrally formed with an engine case (not shown) of the gas turbine engine. Handle pin 40 connects to a mechanism (not shown) that drives vane arm 14 to rotate FIVV 12 as directed by a gas turbine engine controller (not shown).

Hinge pin 20 extends through hole 52 in vane arm 14 and hole 54 in FIVV 12. Hinge pin 20 threadedly engages with FIVV 12 to hold vane arm 14 rotatably fixed with respect to FIVV 12. Tab washer 22 has tab 56 which folds into hole 58 of vane arm 14, and also has tab 60 which folds against head 62 of hinge pin 20 to limit rotation of hinge pin 20 caused by vibration or otherwise.

Connector hole 64 extends through shaft 42 of vane arm 14. Connector hole 66 extends through shaft 30 of FIVV 12. Connector holes 64 and 66 are defined by their respective inner surfaces 68 and 70. When assembled, connector hole 64 is aligned with connector hole 66 to allow male connector 24 and female connector 26 to connect to one-another by extending through connector holes 64 and 66. Male connector 24 has electrically insulating body 72 with outer surface 74, and female connector 26 has electrically insulating body 76 with outer surface 78. Inner surface 68, inner surface 70, outer surface 74, and outer surface 78 are each substantially kidney-shaped, with a relatively narrow width W and a relatively long length L (width W and length L are shown with respect to outer surface 78 of electrically insulating body 76 in FIG. 3 for clarity). Because connector holes 64 and 66 have a relatively narrow width W in a direction perpendicular to centerline axis $C_L$, connector holes 64 and 66 have a relatively small impact on torque strength of shafts 30 and 42. Inner surface 68, inner surface 70, outer surface 74, and outer surface 78 being kidney-shaped also helps ensure male connector 24 and female connector 26 are properly aligned when removably connected to each other. Connector holes 64 and 66 can also be referred to as circular slots, since they are shaped as slots that curve in a circular direction about centerline axis $C_L$.

O-ring seal 79 extends around outer surface 74 of insulating body 72 to provide a seal against inner surface 70 of connector hole 66.

Female connector 26 is connected to cable 80, which can connect to a wire harness (not shown), which in turn can connect to an engine controller (not shown). Male connector 24 is connected to heater 82 via heater connection pad 84 and also connected to temperature sensor 86. Temperature sensor 86 can be a resistance temperature detector (RTD) positioned on FIVV 12 for sensing temperature of FIVV 12. In the illustrated embodiment, temperature sensor 86 is a relatively long and thin RTD positioned between spar blade 29 and composite layers 28. Heater 82 is also positioned on FIVV 12 for deicing FIVV 12. In the illustrated embodiment, heater 82 is a thin, flat layer within composite layers 28. Male connector 24 has four pins 88 which mate with four sockets 90 to connect the engine controller to heater 82 and temperature sensor 86. The engine controller receives temperature signals from temperature sensor 86 and activates heater 82, as necessary, to device FIVV 12.

Figure 2:
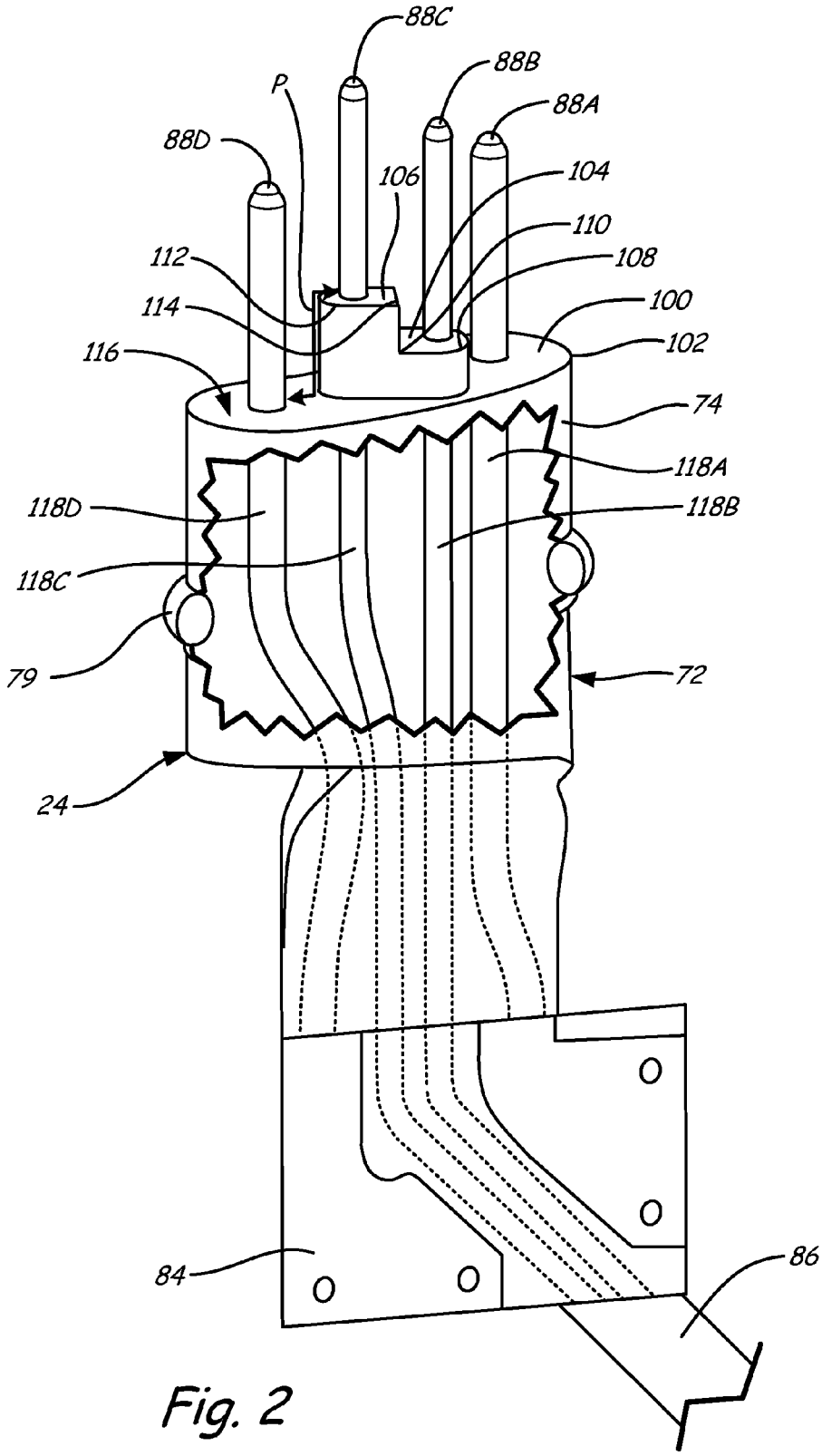
FIG. 2 is a schematic perspective partially cut-away view of a male connector used in the connection assembly of FIG. 1.

FIG. 2 is a schematic perspective view of male connector 24. Electrically insulating body 72 of male connector 24 has outer surface 74 extending from and substantially perpendicular to base mating surface 100. Outer surface 74 meets base mating surface 100 at perimeter 102 of base mating surface 100, which is substantially kidney-shaped. Stepped mating surfaces 104 and 106 are offset from base mating surface 100. Stepped mating surface 104 is substantially parallel to and elevated above base mating surface 100. Stepped mating surface 106 is substantially parallel to and elevated above both stepped mating surface 104 and base mating surface 100. Stepped mating surface 106 is horizontally adjacent to stepped mating surface 104. The phrase "horizontally adjacent" as used herein means that stepped mating surface 106 appears to be adjacent to stepped mating surface 104 when viewed from a position above and normal to stepped mating surfaces 104 and 106, even though stepped mating surface 106 is elevated vertically above stepped mating surface 104. Stepped mating surface 104 has curved perimeter edge 108 and straight perimeter edge 110. Stepped mating surface 106 has curved perimeter edge 112 and straight perimeter edge 114 horizontally adjacent straight perimeter edge 110. Base mating surface 100, stepped mating surface 104, and stepped mating surface 106 will be collectively referred to as male mating surface 116.

Pins 88A-88D extend from electrically insulating body 72 in substantially the same direction so as to be substantially parallel to one-another. Pins 88A and 88D extend from base mating surface 100. Pin 88B extends from stepped mating surface 104. Pin 88C extends from stepped mating surface 106. Pins 88B and 88C are positioned substantially between pins 88A and 88D. Stepped mating surfaces 104 and 106 are also positioned substantially between pins 88A and 88D. Pins 88A and 88D have a larger diameter than pins 88B and 88C. Pins 88A-88D are made of electrically conducting material.

Electrically insulating body 72 has been partially cut-away to show details within. Pins 88A and 88D are electrically connected to heater connection pad 84 via wires 118A and 118D, respectively, for transmitting power to heater 82 (shown in FIG. 1). Pins 88B and 88C are electrically connected to temperature sensor 86 via wires 118B and 118C, respectively, for transmitting temperature signals from temperature sensor 86. Pins 88A and 88D transmit power that is relatively high voltage and high current as compared to the signals transmitted by pins 88B and 88C.

Figure 3:
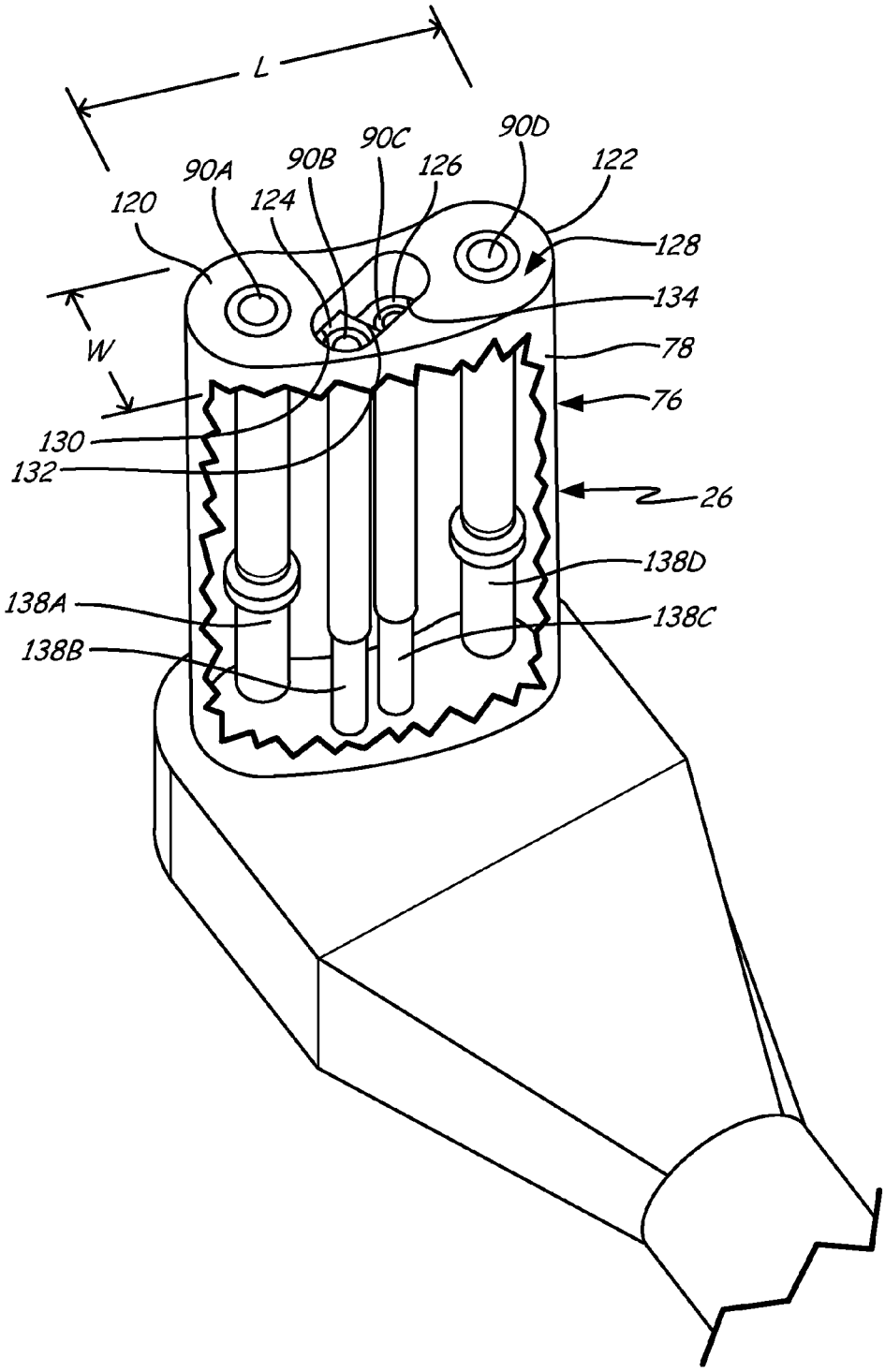
FIG. 3 is a schematic perspective partially cut-away view of a female connector used in the connection assembly of FIG. 1.

FIG. 3 is a schematic perspective view of female connector 26. Electrically insulating body 76 of female connector 26 has outer surface 78 extending from and substantially perpendicular to base mating surface 120. Outer surface 78 meets base mating surface 120 at perimeter 122 of base mating surface 120, which is substantially kidney-shaped. Stepped mating surfaces 124 and 126 are offset from base mating surface 120. Stepped mating surface 124 is substantially parallel to and sunken below base mating surface 120. Stepped mating surface 126 is substantially parallel to and sunken below both stepped mating surface 124 and base mating surface 120. Stepped mating surface 126 is horizontally adjacent to stepped mating surface 124, though sunken vertically lower. Stepped mating surface 124 has curved perimeter edge 130 and straight perimeter edge 132. Stepped mating surface 126 has curved perimeter edge 134 and straight perimeter edge 136 (shown in FIG. 3A) horizontally adjacent straight perimeter edge 132. Base mating surface 120, stepped mating surface 124, and stepped mating surface 126 will be collectively referred to as female mating surface 128.

Electrically insulating body 76 has been partially cut-away to show details within. Sockets 90A-90D are aligned in substantially the same direction so as to be substantially parallel to one-another. Sockets 90A and 90D extend from an interior portion of electrically insulating body 76 to base mating surface 120. Socket 90B extends from an interior portion of electrically insulating body 76 to stepped mating surface 124. Socket 90C extends from an interior portion of electrically insulating body 76 to stepped mating surface 126. Sockets 90B and 90C are positioned substantially between sockets 90A and 90D. Stepped mating surfaces 124 and 126 are also positioned substantially between sockets 90A and 90D. Sockets 90A and 90D have a larger diameter than sockets 90B and 90C. Sockets 90A-90D are made of electrically conducting material.

Sockets 90A-90D are electrically connected to the wire harness (not shown) and ultimately to the engine controller (not shown) via wires 138A-138D, respectively. Sockets 90A and 90D transmit power that is relatively high voltage and high current as compared to the signals transmitted by sockets 90B and 90C.

Function of male connector 24 and female connector 26 will now be described with respect to both FIG. 2 and FIG. 3. When male connector 24 is connected to female connector 26, male mating surface 116 can be positioned near female mating surface 128. Male mating surface 116 can be substantially adjacent female mating surface 128 or can be spaced from female mating surface 128 by positioning interfacial seal 140 (shown in FIG. 4) between base mating surfaces 100 and 120. Base mating surface 100 can be positioned near base mating surface 120; stepped mating surface 104 can be positioned near stepped mating surface 124; and stepped mating surface 106 can be positioned near stepped mating surface 126.

Pins 88A-88D each require sufficient electrical insulation to prevent arcing to nearby conductors, such as each other, spar 27 (shown in FIG. 1), or other conducting surfaces. Similarly, sockets 90A-90D also requires sufficient electrical insulation to prevent arcing to nearby conductors, such as each other. The same is true of wires 118A-118D and wires 138A-138D. Electrically insulating bodies 72 and 76 can provide that insulation to prevent arcing for those portions of pins 88A-88D, sockets 90A-90D, wires 118A-180D, and wires 138A-138D which electrically insulating bodies 72 and 76 cover.

However, pins 88A-88D extend from electrically insulating body 72 to insert into sockets 90A-90D. When male connector 24 is connected to female connector 26, pins 88A-88D are positioned in sockets 90A-90D. To the extent male mating surface 116 is not perfectly sealed against female mating surface 128, exposed portions of pins 88A-88D are insulated by only air. The suitability of air as an electric insulator depends in part on dielectric distance between two conductors. A table of suitable dielectric distances depending on voltage and current can be found in MIL-STD-38999. For ordinary conductors, the distance between exposed portions of two pins would be that of a perpendicular line directly between those pins. However, for male connector 24, distance between an exposed portion of pin 88D and pin 88C extends along path P, which travels across a portion of base mating surface 100, up to stepped mating surface 106, and across a portion of stepped mating surface 106. Thus, extending pin 88C from stepped mating surface 106 instead of base mating surface 100 increases the effective distance between pin 88C and pin 88D for electrical insulation purposes. Similarly, extending pin 88B from stepped mating surface 104 instead of base mating surface 100 increases the effective distance between pin 88B and pin 88A for electrical insulation purposes. Similarly, extending pin 88B from stepped mating surface 104 instead of stepped mating surface 106 increases the effective distance between pin 88B and pin 88C for electrical insulation purposes. Furthermore, positioning stepped mating surfaces 104 and 106 between pins 88A and 88D also increases the effective distance between pins 88A and 88D for electrical insulation purposes, even though pins 88A and 88D both extend from base mating surface 100. Stepped mating surfaces 124 and 126 increases the effective distance between sockets 90A, 90B, 90C, and 90D in a similar manner. In an alternative embodiment, one or both of pins 88A and 88D can also extend from a stepped mating surface that is offset from base mating surface 100.

Elevating stepped mating surfaces 104 and 106 above base mating surface 100 allows pins 88A-88D to be horizontally positioned closer together, and allows overall size of male connector 24 to be reduced. As a corollary, sinking stepped mating surfaces 124 and 126 below base mating surface 120 allows sockets 90A-90D to be positioned closer together, and allows overall size of female connector 26 to be reduced. This allows connector holes 64 and 66 to have their sizes reduced, thus increasing strength of shafts 30 and 42. In an alternative embodiment, stepped mating surfaces 104 and 106 can be sunken below base mating surface 100 and stepped mating surfaces 124 and 126 can be elevated above base mating surface 120.

Figure 3A:
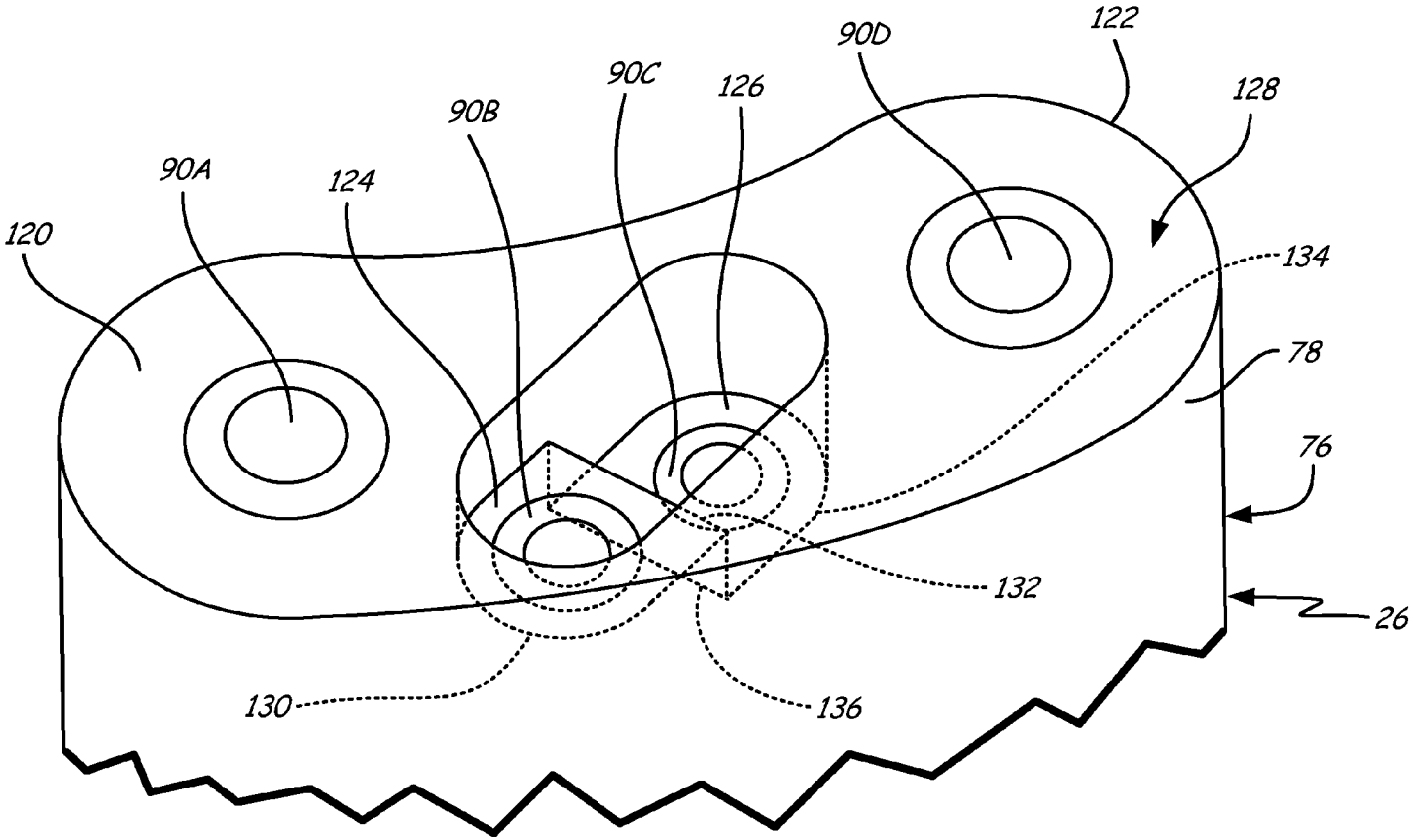
FIG. 3A is an enlarged schematic perspective view of the female connector of FIG. 3.

FIG. 3A is an enlarged schematic perspective view of female connector 26. FIG. 3A is enlarged to show greater detail of stepped mating surfaces 124 and 126, including curved perimeter edge 130, straight perimeter edge 132, curved perimeter edge 134, and straight perimeter edge 136 each shown partially or entirely in phantom.

Figure 4:
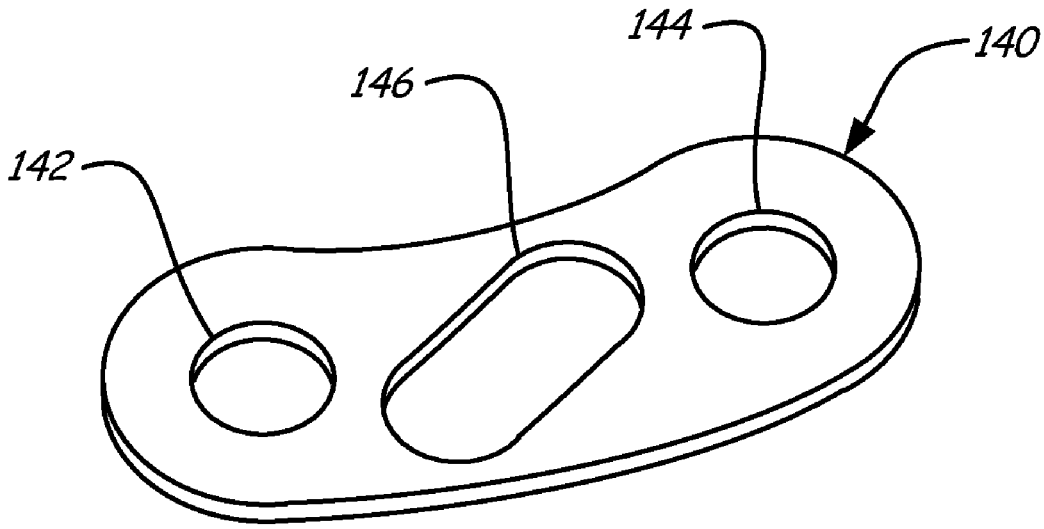
FIG. 4 is a schematic perspective view of an interfacial seal for positioning between the male connector of FIG. 2 and the female connector of FIG. 3.

FIG. 4 is a schematic perspective view of interfacial seal 140. Interfacial seal 140 is a thin silicone gasket that can be positioned between base mating surface 100 (shown in FIG. 2) and base mating surface 120 (shown in FIG. 3) to reduce exposure of pins 88A-88D (shown in FIG. 2) and sockets 90A-90D (shown in FIG. 3) to moisture. Interfacial seal 140 has a substantially similar shape to that of base mating surfaces 100 and 120. Hole 142 aligns with socket 90A to allow pin 88A to pass through interfacial seal 140. Hole 144 aligns with socket 90D to allow pin 88D to pass through interfacial seal 140. Hole 146 aligns with curved perimeter edges 108, 112, 130, and 134 (shown in FIGS. 2 and 3) to allow pin 88B, pin 88C, stepped mating surface 104, and stepped mating surface 106 (shown in FIGS. 2 and 3) to pass through interfacial seal 140.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. For example, use of male connector 24 and female connector 26 is not limited for use in deicing a fan inlet variable vane. Rather, male connector 24 and female connector 26 can be used with other rotating mechanical couplings or in virtually any application where space is limited but electrical arcing between connector pins is a concern.

The invention claimed is:

1. An assembly comprising:

a male electrical connector including:

a first electrically insulating body having a first base mating surface and a first stepped mating surface offset from the first base mating surface;

a first electrically conducting pin extending from the first base mating surface; and a second electrically conducting pin extending from the first stepped mating surface;

a female electrical connector including:

a second electrically insulating body having a second base mating surface and a second stepped mating surface offset from the second base mating surface;

a first electrically conducting socket extending from an interior portion of the second electrically insulating body to the second base mating surface; and a second electrically conducting socket extending from the interior portion of the second electrically insulating body to the second stepped mating surface, wherein the male electrical connector is removably connected to the female electrical connector such that the first pin is in the first socket, the second pin is in the second socket, the first base mating surface is positioned near the second base mating surface, and the first stepped mating surface is positioned near the second stepped mating surface; and first and second mechanical couplings coupled together and having a hole extending through the first and second mechanical couplings, wherein the male and female connectors are positioned in the hole.

2. The male electrical connector of claim 1, wherein the first stepped mating surface is elevated above the first base mating surface.

3. The assembly of claim 1, and further comprising:

a third electrically conducting pin extending from a third stepped mating surface of the first electrically insulating body, wherein the third stepped mating surface is offset from both the first base mating surface and the first stepped mating surface;

a fourth electrically conducting pin extending from the first base mating surface;

a third electrically conducting socket extending from the interior portion of the second electrically insulating body to a fourth stepped mating surface of the second electrically insulating body, wherein the fourth stepped mating surface is offset from both the second base mating surface and the second stepped mating surface; and a fourth electrically conducting socket extending from the interior portion of the second electrically insulating body to the second base mating surface.

4. The male electrical connector of claim 3, wherein the first stepped mating surface is horizontally adjacent the third stepped mating surface, and wherein the first and third stepped mating surfaces are positioned substantially between the first and fourth electrically conducting pins.

5. The male electrical connector of claim 3, wherein the first stepped mating surface, the third stepped mating surface, and the first base mating surface are substantially parallel.

6. The male electrical connector of claim 3, wherein a perimeter of the first stepped mating surface has a curved edge and a substantially straight edge horizontally adjacent to an edge of the third stepped mating surface.

7. The female electrical connector of claim 3, wherein the second stepped mating surface is horizontally adjacent the fourth stepped mating surface, and wherein the second and fourth stepped mating surfaces are positioned substantially between the first and fourth electrically conducting sockets.

8. The female electrical connector of claim 3, wherein a perimeter of the second stepped mating surface has a curved edge and a substantially straight edge horizontally adjacent to an edge of the fourth stepped mating surface.

9. The female electrical connector of claim 1, wherein the second stepped mating surface is sunken below the second base mating surface.

10. The female electrical connector of claim 1, wherein the second electrically insulating body has an outer surface extending from the perimeter of the second base mating surface, and wherein the outer surface is substantially perpendicular to the second base mating surface.

11. The assembly of claim 1, wherein an inner surface of the hole, an outer surface of the first electrically insulating body, and an outer surface of the second electrically insulating body are all substantially kidney-shaped.

12. The assembly of claim 1, wherein the first and second mechanical coupling are positioned inside and rotatable with respect to a bushing.

13. The assembly of claim 1, wherein the first mechanical coupling is part of a fan inlet variable vane for use in a gas turbine engine and the second mechanical coupling is part of a vane arm for rotating the fan inlet variable vane.

14. The assembly of claim 13, and further comprising:

a heater connected to the first connector and positioned on the fan inlet variable vane; and a temperature sensor connected to the first connector and positioned on the fan inlet variable vane.

15. The assembly of claim 1, and further comprising:

an interfacial seal positioned between the first base mating surface and the second base mating surface, wherein the interfacial seal, the first base mating surface, and the second base mating surface share a substantially similar shape.

16. The assembly of claim 1, wherein a perimeter of the first base mating surface, a perimeter of the second base mating surface, and a surface of the hole are each substantially kidney-shaped.

* * * * *